US006213111B1

(12) United States Patent
Alexander et al.

(10) Patent No.: US 6,213,111 B1
(45) **Date of Patent: *Apr. 10, 2001**

(54) GAS HOLDING CHAMBER FOR AIR-POWERED PAINTBALL GUNS

(76) Inventors: Aaron K. Alexander, 2427 N. Franklin Rd.; Larry G. Alexander, 2445 N. Franklin Rd, both of Indianapolis, IN (US) 46219

( * ) Notice: Subject to any disclaimer, the term of this patent is extended or adjusted under 35 U.S.C. 154(b) by 0 days.

This patent is subject to a terminal disclaimer.

(21) Appl. No.: 09/428,257

(22) Filed: Oct. 27, 1999

Related U.S. Application Data

(63) Continuation-in-part of application No. 09/300,148, filed on Apr. 27, 1999, which is a continuation of application No. 08/882,672, filed on Jun. 25, 1997, now Pat. No. 5,904,133.

(51) Int. Cl.[7] ..... F41B 11/00
(52) U.S. Cl. ..... 124/71
(58) Field of Search ..... 124/71–74

(56) References Cited

U.S. PATENT DOCUMENTS

| | | | | |
|---|---|---|---|---|
| 3,633,560 | * | 1/1972 | DeFreitas | 124/56 |
| 4,038,961 | | 8/1977 | Olofsson . | |
| 5,381,778 | * | 1/1995 | D'Andrade et al. . | |
| 5,515,838 | * | 5/1996 | Anderson . | |
| 5,586,545 | * | 12/1996 | McCaslin . | |
| 5,613,483 | | 3/1997 | Lukas et al. . | |
| 5,727,538 | * | 3/1998 | Ellis . | |
| 5,769,066 | | 6/1998 | Schneider . | |
| 5,813,392 | * | 9/1998 | McCaslin . | |
| 5,904,133 | | 5/1999 | Alexander et al. . | |

* cited by examiner

*Primary Examiner*—Peter M. Poon
*Assistant Examiner*—James S. Bergin
(74) *Attorney, Agent, or Firm*—Woodard, Emhardt, Naughton, Moriarty & McNett

(57) ABSTRACT

An air chamber that increases the volume of air stored inside a paintball gun. An increased volume of air allows the use of low-pressure/high volume valves in the gun.

9 Claims, 8 Drawing Sheets

GAS HOLDING CHAMBER FOR AIR-POWERED PAINTBALL GUNS

CROSS-REFERENCE TO RELATED APPLICATION

This application is a continuation-in-part of U.S. patent application Ser. No. 09/300,148, filed Apr. 27, 1999 which is a continuation of 08/882,672, filed Jun. 25, 1997, now U.S. Pat. No. 5,904,133.

FIELD OF THE INVENTION

The present invention pertains to paintball guns and more particularly, to a gas holding chamber for use with $CO_2$, nitrogen or compressed air powered paintball guns.

BACKGROUND OF THE INVENTION

Today's high tech paintball guns generally run off of $CO_2$, nitrogen or compressed air as a power source. These power sources require a specific volume of gas or a specific pressure of gas to fire the paintball at the correct velocity. You can use one or the other. Most paintball guns use the higher pressure/low volume method to shoot a paintball. Then, a few years ago, miniature pressure regulators became available for use on paintball guns allowing players to use a lower pressure gas to fire the paintball, thus relying on more volume of air to fire the paintball. But, the pressure never got below 500 psi into the air chamber of the paintball gun because valves at that time were not built for efficiency at lower pressures. At the same time paintball pressure regulators became available on the market, manufacturers and after-market customizers shortened the paintball guns to reduce weight by cutting off part of the air chamber, thus reducing the amount of stored gas. At that time there was no problem caused by reducing the length of the chamber because high pressure/low volume was being used. But as the newer, more gas efficient air valves that operate on a lower pressure/high volume (ranging from 100 psi to 400 psi) started to become available. The lack of air-chamber space has caused the paintball guns not to be able to shoot the paintball at the proper velocity using a lower pressure/high volume setting less than 500 psi.

What is needed is a reservoir chamber that couples into the air chamber of the paintball gun thus increasing the chamber's volume capacity to allow paintball guns to use the more efficient lower pressure/high volume air valves. The chamber should not significantly increase the weight or change the balance of the paintball gun and work without modifying the paintball gun by drilling out the air chambers. The air chamber needs to allow air to rush from the reservoir more rapidly through a substantially straight-line passage to the valve; unlike the previous mounting bolt that allows air to enter the gun 90 degrees from the valve and pass through a small hole in the front mounting block bolt thus restricting air flow.

SUMMARY OF THE INVENTION

The present invention accomplishes these objectives in a first embodiment by providing a reservoir that can thread into an existing bolt hole on the air chamber of the paintball gun, replacing the old bolt. The air reservoir has threads for the bolt hole, inlet holes to allow air into the air-chamber, a flange to hold an o-ring on the gun to seal air inside, a large chamber space to store a large volume of air, a plug to seal the end of the chamber and provide means of tightening the air reservoir to the gun.

In the second through fifth embodiments, the present invention provides a reservoir that replaces the existing vertical mount coupled to the air chamber of the paintball gun, thereby providing internal gas communication between the reservoir and the air chamber. The air reservoir has a distal end with integrated o-ring seals that mounts into the mounting hole previously used by the vertical mount. One or more screws hold the reservoir in place. The reservoir further includes a large chamber space to store a large volume of gas, an inlet hole to allow air into the air chamber (or to mount a pressure regulator directly thereto), at least one transfer tube to transfer gas from the air reservoir to the air chamber in the gun in a substantially straight line, and a plug to seal the end of the reservoir.

DETAILED DESCRIPTION OF THE PREFERRED EMBODIMENT

Figure 1:
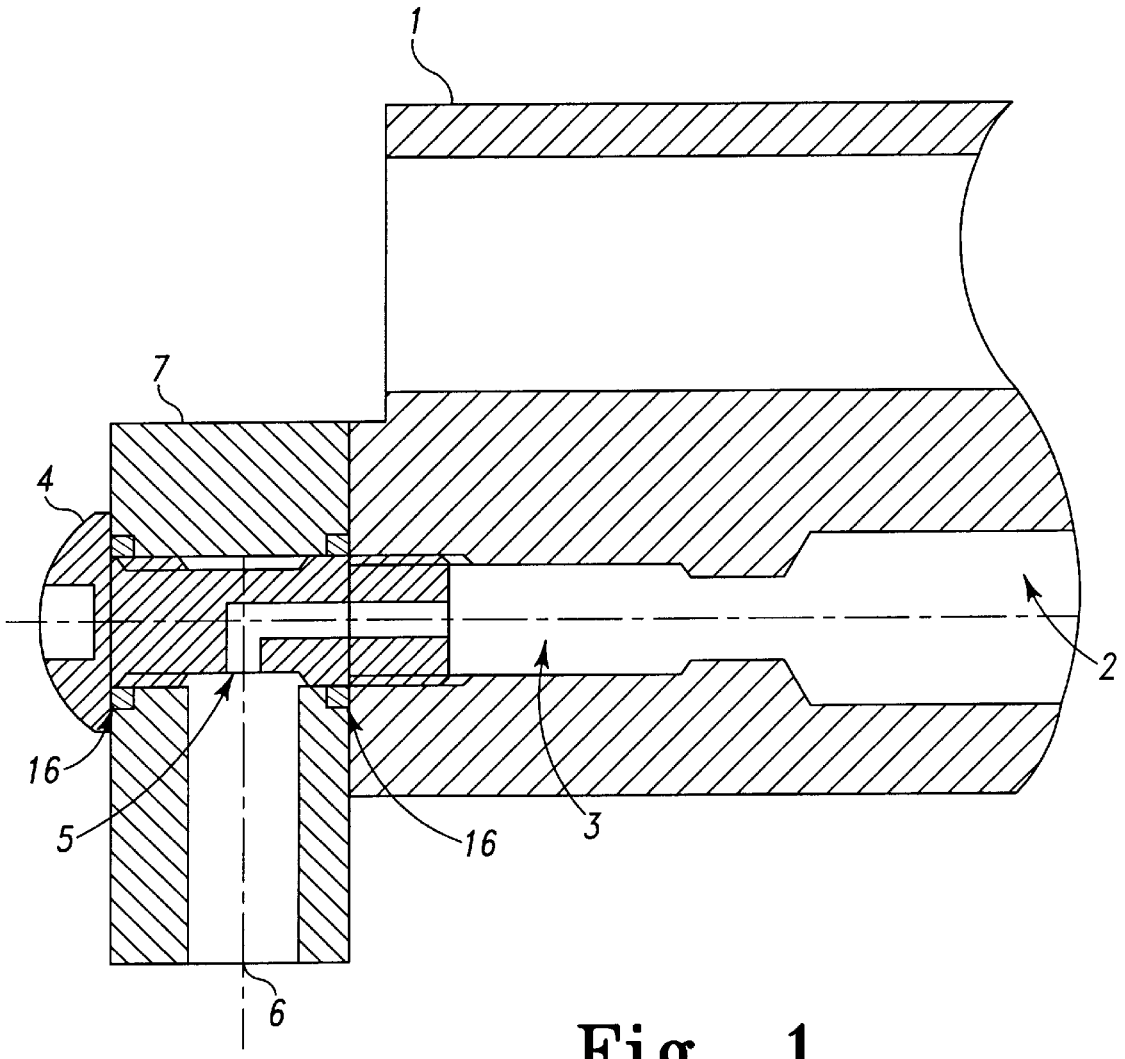
FIG. 1 is a cross-section view showing the location of the air chamber on the paintball gun and the prior art mounting bolt and air inlet.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 2:
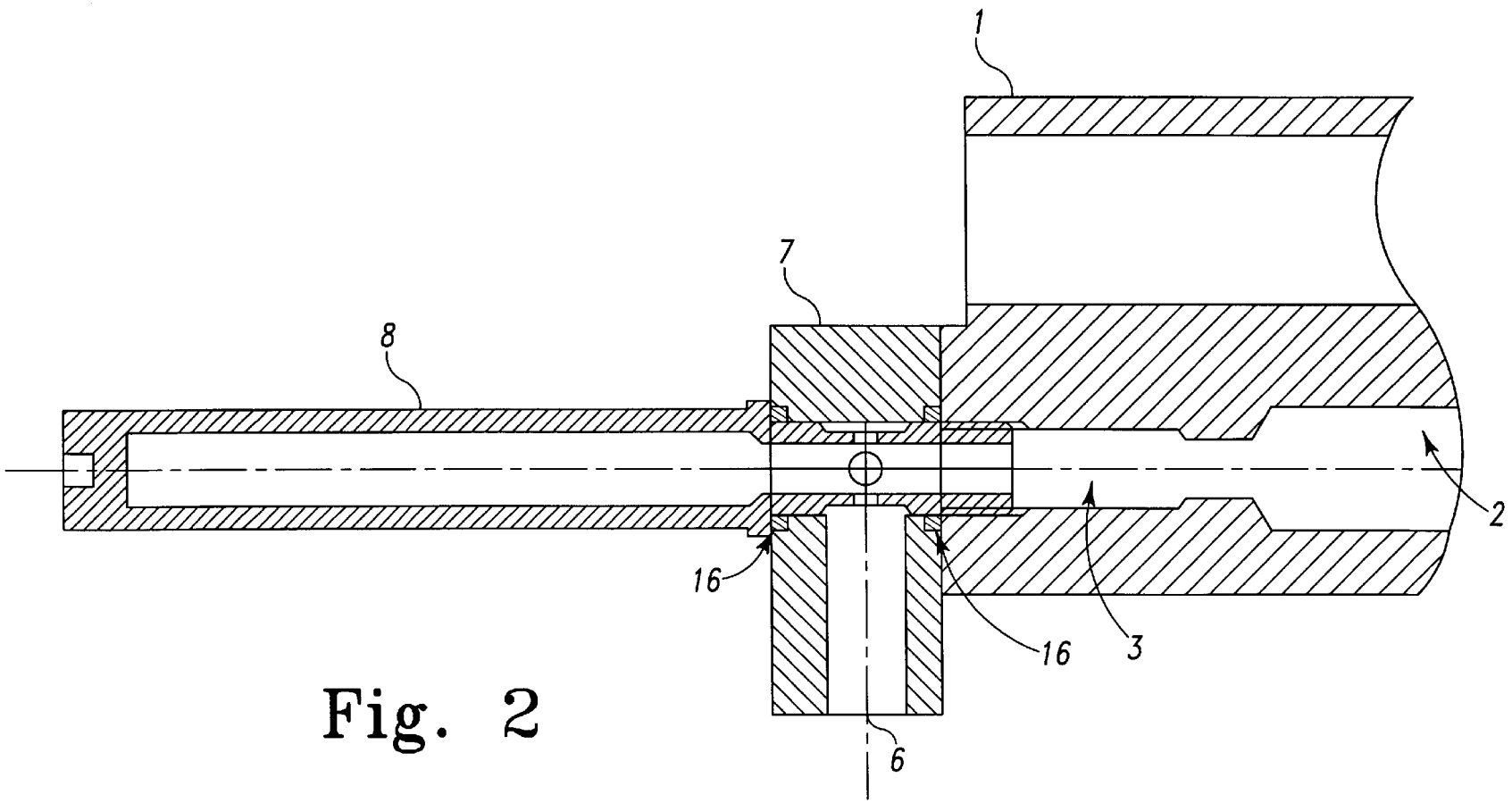
FIG. 2 is a cross-section view of a first embodiment air reservoir of the present invention mounted to a prior art paintball gun.
Figure 3:
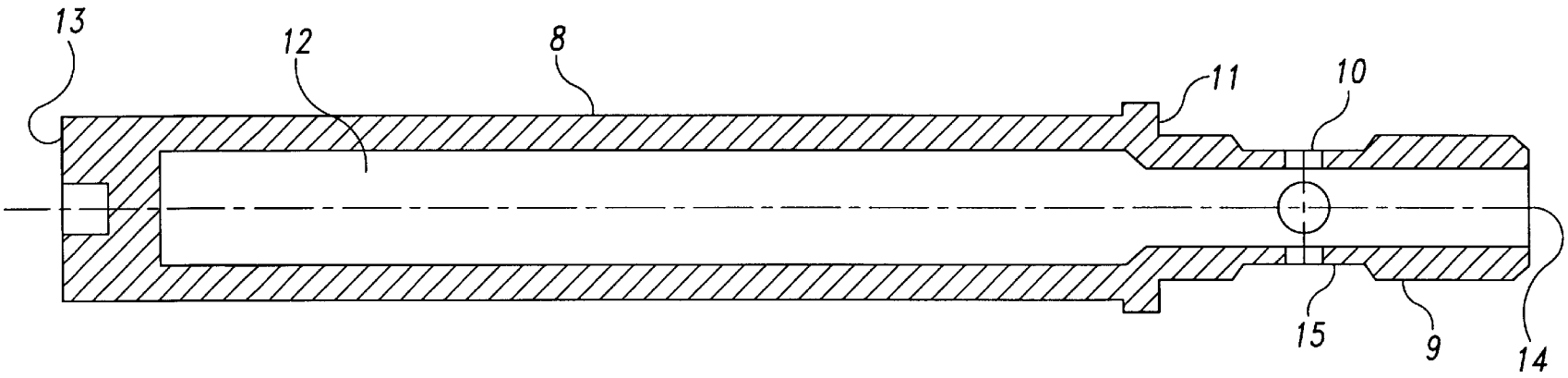
FIG. 3 is a cross-section view of the first embodiment air reservoir uncoupled from the paintball gun.

Referring now to FIGS. 1–3 of the accompanying drawings, the first embodiment air reservoir of the present invention will be described. FIG. 1 and 2 essentially shows where and how the air reservoir 8 is located in place of the previous bolt 4. The paintball gun body 1 is shown to show the location of valve chamber 2 and the air chamber 3 and the location of front mounting block 7 and the older design mounting block bolt 4. The front block mounting bolt 4 screws into paintball gun body 1 and has a small air transfer hole 5 to allow air to flow through from air inlet 6 to the air chamber 3. The air transfer hole 5 is small which restricts air flow and reduces performance, so people have to increase air flow through the bolt by drilling the holes larger. That works to increase flow rate but also reduces the strength of the bolt and still does not solve the problem of the reduced chamber space.

For a comparison, FIG. 2 shows the present invention, the air reservoir 8 mounted in the same location as the older front mounting block bolt 4 to pictorially show the increased size of the air chamber.

FIG. 3 shows a cross section view of a first embodiment of our present invention, the air reservoir 8 where 9 indicates the threaded end that attaches to the paintball gun body 1 which is shown on FIGS. 1 and 2. A turned down diameter 15 which allows air to flow around the whole diameter and enter through multiple holes 10 and fill the air chamber 3 and the air reservoir chamber 12. A flange 11 has been turned on the air reservoir to secure an o-ring 16 in place and seal air inside and apply pressure to keep the mounting block secured to the paintball gun body 1. The transfer tube 14 has been enlarged over that of the old mounting block bolt 4 which allows air to rush from the air chamber 12 in a straight line path to the air chamber 3 in less time and with less restriction than in previous designs referred to in FIG. 1. The air reservoir also has a plug 13 to seal air inside the reservoir and provide the air reservoir with the means of being tightened down to the paintball gun body.

Figure 4:
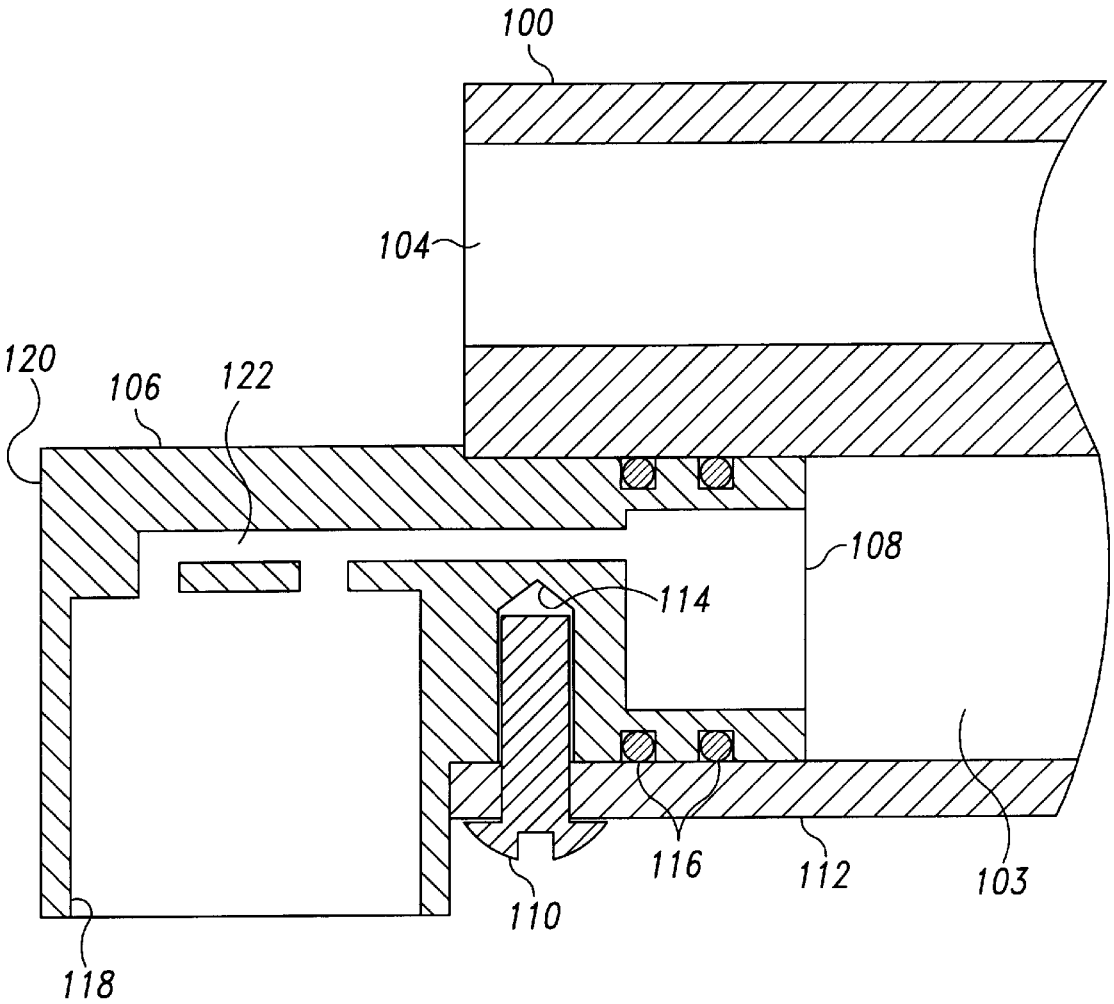
Fig. 4 (PRIOR ART)
FIG. 4 is a cross-section view of a prior art vertical mount coupled to a prior art paintball gun.

Referring now to FIG. 4, there is shown a paintball gun body 100 having an air chamber 103 and a barrel 104. Instead of the front mounting block 7 and mounting block bolt 4 of the design of FIG. 1, the paintball gun body 100 includes a vertical mount 106 having a distal end portion 108 that is received within the air chamber 103. The vertical mount 106 is maintained within the position illustrated in FIG. 4 by means of a bolt 110 extending through the wall 112 defining the air chamber 103 and into a threaded hole 114 formed within the vertical mount 106. A pair of o-ring seals 116 prevent air within the air chamber 103 from escaping around the periphery of the distal end 108.

The vertical mount 106 further includes a threaded recess 118 formed at the distal end 120, the threaded recess 118 being adapted to couple a pressure regulator, expansion chamber, or other source of compressed air (or other gas). The compressed air is communicated to the air chamber 103 through a passage 122 formed within the vertical mount 106. As with the embodiment illustrated in FIG. 1, the passage 122 is small and restricts air flow from the air source, plus requires the air to traverse a 90 degree bend prior to reaching the air chamber 103.

Figure 5:
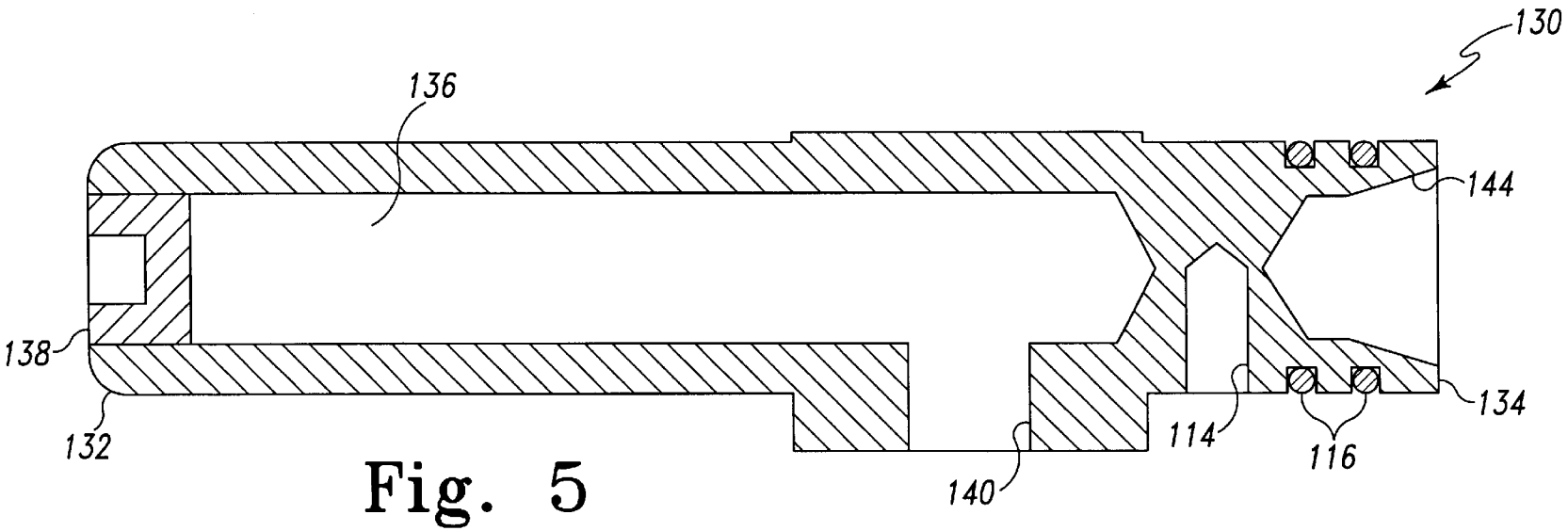
FIG. 5 is a cross-section view of a second embodiment air reservoir of the present invention.
Figure 6:
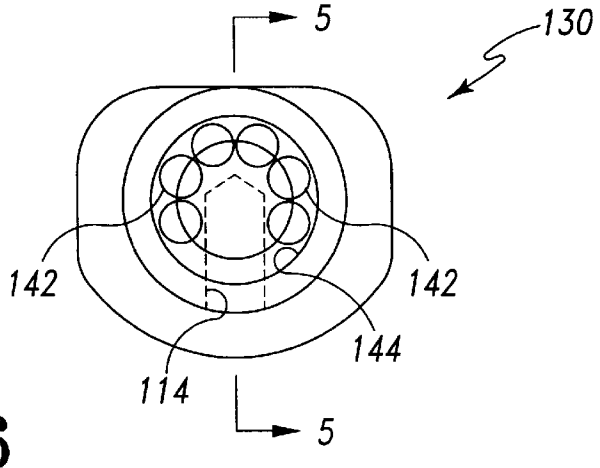
FIG. 6 is an end view of the second embodiment air reservoir of the present invention.

A second embodiment of the present invention is illustrated in FIGS. 5 and 6 and indicated generally at 130. The air reservoir 130 includes a distal end 132 and a proximal end 134, wherein the proximal end 134 is adapted to mount within the air chamber 103 in the same manner as the vertical mount 106. The air reservoir 130 therefore includes o-ring seals 116 and a threaded hole 114 for receiving the bolt 110.

The air reservoir 130 includes an air reservoir chamber 136 formed longitudinally therein and sealed on the distal end by a threaded plug 138. Air (or other suitable compressed gas) is supplied to the air reservoir chamber 136 through a threaded passageway 140. An adapter (not shown) is preferably coupled to the threaded passageway 140 and provides an appropriate mounting surface for the source of compressed air, such as a pressure regulator, expansion chamber, etc. The proximal end 134 has a bore 144 formed therein which faces the air chamber 103 when the air reservoir 130 is installed therein.

As best shown in FIG. 6, the air reservoir 130 includes at least one, and preferably a plurality, of transfer tubes 142 formed between the air reservoir chamber 136 and the bore 144. As shown in FIG. 6, the transfer tubes 142 are positioned so as not to intersect the space occupied by the threaded hole 114. The transfer tubes 142 provide a substantially straight line of air flow between the air reservoir chamber 136 and the air chamber 103, plus provide a relatively high volume space for the air to flow between these two spaces.

Figure 7:
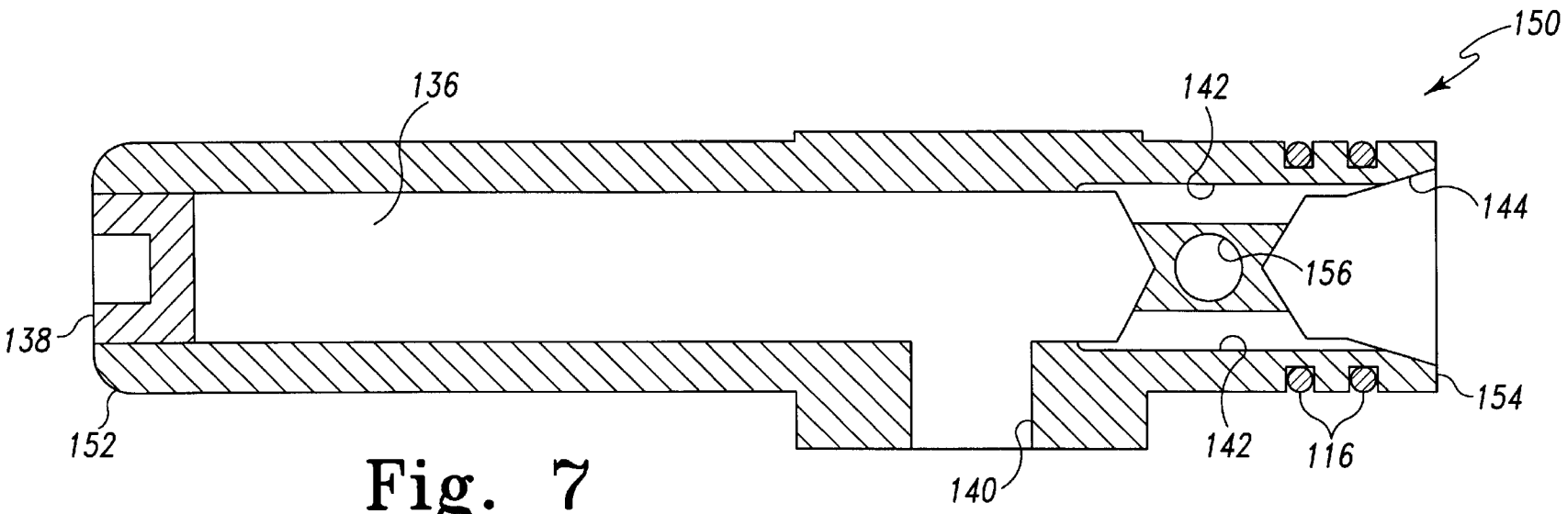
FIG. 7 is a cross-section view of a third embodiment air reservoir of the present invention.
Figure 8:
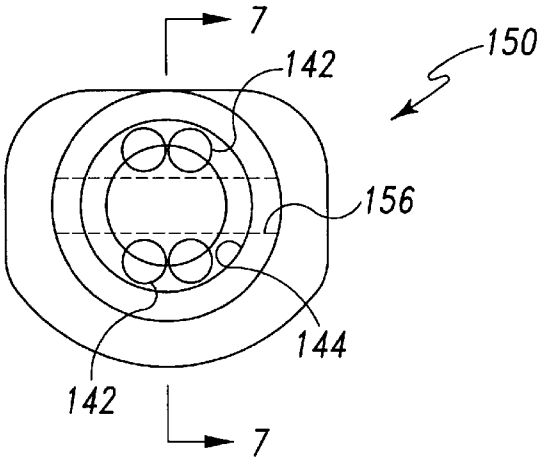
FIG. 8 is an end view of the third embodiment air reservoir of the present invention.

A third embodiment air reservoir of the present invention is illustrated in FIGS. 7 and 8, and indicated generally at 150. The air reservoir 150 includes a distal end 152 and a proximal end 154. As with the second embodiment air reservoir 130, the third embodiment air reservoir 150 is designed to sealingly mate within the air chamber 103 by use of the o-ring seals 116, however the air reservoir 150 includes a threaded bore 156 therethrough, which allows the air reservoir 150 to be secured to the paintball gun body 1 by means of a pair of bolts (not shown) engaging either end of the threaded passage 156 and extending through the wall 112 defining the air chamber 103 (see FIG. 4).

Like the second embodiment air reservoir 130, the third embodiment air reservoir 150 includes an internal air reservoir chamber 136, distal end plug 138, proximal end bore 144 and threaded passageway 140. Air reservoir 150 also includes at least one, and preferably a plurality of transfer tubes 142 in order to allow air transfer between the air reservoir chamber 136 and the air chamber 103. As best shown in FIG. 8, the transfer tubes 142 are preferably arranged so as to avoid interference with the threaded bore 156 and to provide a substantially straight line for the compressed air to travel from the air reservoir chamber 136 to the air chamber 103.

Figure 9:
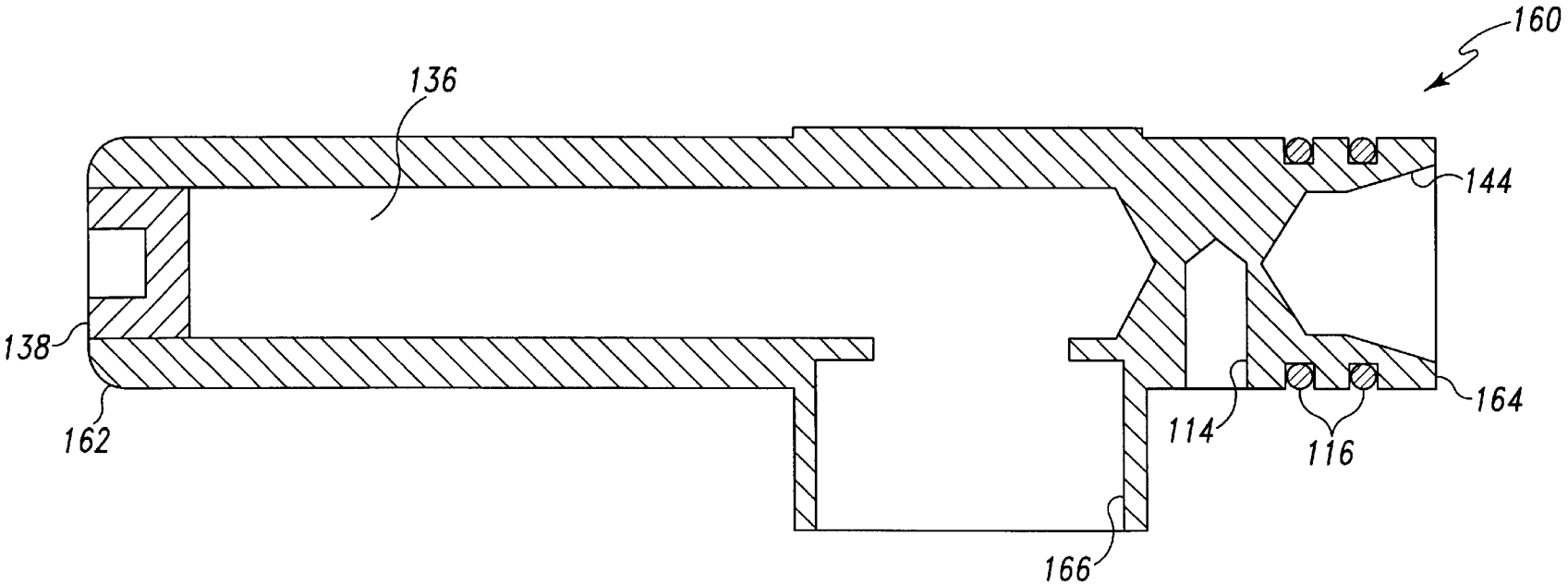
FIG. 9 is a cross-section view of a fourth embodiment air reservoir of the present invention.

Referring now to FIG. 9, there is illustrated a fourth embodiment air reservoir of the present invention, indicated generally at 160. The air reservoir 160 includes a distal end 162 and a proximal end 164 and is substantially identical to the second embodiment air reservoir 130 of FIGS. 5 and 6, with the exception that the air passageway 140 is replaced by a threaded passageway 166 that is substantially larger than the passageway 140. The threaded passageway 166 is sized and shaped so as to allow direct coupling with a pressure regulator, expansion chamber, or other source of compressed gas.

Figure 10:
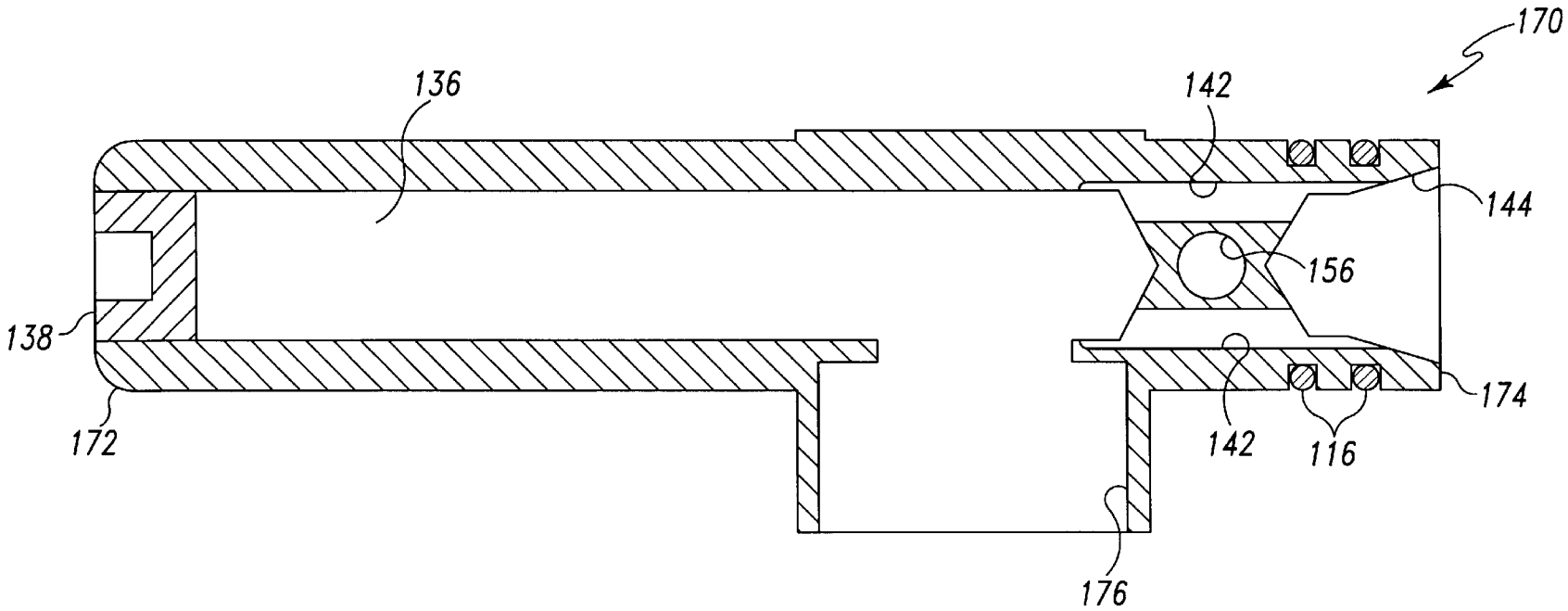
FIG. 10 is a cross-section view of a fifth embodiment air reservoir of the present invention.

Referring now to FIG. 10, a fifth embodiment of the present invention is illustrated and indicated generally at 170. The air reservoir 170 includes a distal end 172 and a proximal end 174 and is substantially identical to the third embodiment air reservoir 150 of FIGS. 7 and 8, with the exception that the air passageway 140 is replaced with a substantially larger threaded passageway 176. As with the air reservoir 160, the air reservoir 170 includes the threaded passageway 176 that is sized and shaped so as to couple directly to a source of compressed gas, such as a pressure regulator, expansion chamber, etc.

The second, third, fourth and fifth embodiments of the present invention function substantially identically to the first embodiment of the present invention in that they provide an increased chamber volume 136 for the storage of compressed gas, and then provide a substantially straight path for this gas to enter the air chamber 103 when the paintball gun 100 is fired. This increased volume of gas, and the efficient manner with which it is transferred to the air chamber 103, allow the paintball gun to operate at a lower, more efficient gas pressure.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. An air reservoir chamber adapted to couple to an air-powered gun body, the air reservoir chamber comprising:

a chamber body having a proximal end and a distal end;

an air reservoir formed in said chamber body;

at least one hole formed from a surface of said chamber body to said air reservoir proximal of the distal end, said air reservoir communicating with said at least one hole for gas flow therebetween; and at least one transfer tube formed in said distal end and communicating with said air reservoir for gas flow therebetween, wherein gas may flow from said air reservoir to said at least one transfer tube without passing through said at least one hole.

2. The air reservoir chamber of claim 1, wherein said chamber body has a logitongitudinal axis and wherein said air reservoir extends substantially along said longitudinal axis.

3. The air reservoir chamber of claim 1, further comprising:

a threaded surface formed on an exterior of said chamber body at said distal end.

4. The air reservoir chamber of claim 3, further comprising:

a turned down diameter section formed on said chamber body proximal of said threaded surface.

5. The air reservoir chamber of claim 1, wherein gas may flow from said air reservoir to said transfer tube in a substantially straight line.

6. The air reservoir chamber of claim 1, further comprising a plug coupled to said proximal end to seal said air reservoir.

7. The air reservoir chamber of claim 6, wherein said plug is threadedly coupled to said proximal end.

8. The air reservoir chamber of claim 1, further comprising:

a sealing member disposed between said chamber body and the gun body.

9. The air reservoir chamber of claim 8, wherein said sealing member comprises at least one o-ring seal.

* * * * *